US011808129B2

(12) United States Patent
Al-Mulhem

(10) Patent No.: US 11,808,129 B2
(45) Date of Patent: Nov. 7, 2023

(54) AUTONOMOUS PRESSURE TRIGGERED WELL LIVENING TOOL WITH EXOTHERMIC NITROGEN PRODUCING CHEMISTRY

(71) Applicant: SAUDI ARABIAN OIL COMPANY, Dhahran (SA)

(72) Inventor: Abdulrahman Abdulaziz Al-Mulhem, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/653,675

(22) Filed: Mar. 7, 2022

(65) Prior Publication Data

US 2023/0279763 A1 Sep. 7, 2023

(51) Int. Cl.

| | |
|---|---|
| ***E21B 43/26*** | (2006.01) |
| ***E21B 43/263*** | (2006.01) |
| ***E21B 37/00*** | (2006.01) |
| ***E21B 34/06*** | (2006.01) |

(52) U.S. Cl.
CPC ..... *E21B 43/263* (2013.01); *E21B 34/063* (2013.01); *E21B 37/00* (2013.01)

(58) Field of Classification Search
CPC ..... E21B 34/063; E21B 37/00; E21B 43/003; E21B 43/263; E21B 43/243; E21B 43/122
See application file for complete search history.

(56) References Cited

U.S. PATENT DOCUMENTS

| | | | | |
|---|---|---|---|---|
| 3,422,760 | A * | 1/1969 | Mohaupt | E21B 43/263 102/326 |
| 8,757,263 | B2 * | 6/2014 | Barykin | E21B 43/003 102/314 |
| 9,863,226 | B2 | 1/2018 | Lastra et al. | |
| 10,858,922 | B2 * | 12/2020 | Hunter | E21B 43/26 |
| 2002/0162662 | A1 | 11/2002 | Passamaneck et al. | |
| 2007/0227737 | A1 | 10/2007 | Delaloye et al. | |
| 2015/0090442 | A1 * | 4/2015 | Lastra | E21B 34/00 166/250.01 |
| 2019/0316450 | A1 * | 10/2019 | Al-Mulhem | C06D 5/06 |

FOREIGN PATENT DOCUMENTS

| | | |
|---|---|---|
| CN | 104420841 A | 3/2015 |
| CN | 102852498 B | 8/2015 |

OTHER PUBLICATIONS

Wrighton, Christopher et al., "A Novel Technique to Revive Killed Wells Back into Production"; Proceedings of the International Petroleum Technology Conference; Paper No. IPTC-20196-Abstract; pp. 1-16; Jan. 13, 2020 (16 pages).

* cited by examiner

*Primary Examiner* — Christopher J Sebesta
(74) *Attorney, Agent, or Firm* — Osha Bergman Watanabe & Burton LLP

(57) ABSTRACT

A wellbore tool may include a port through the body and a first rupture disk disposed on the body and covering the port, the body defining a first interior chamber and a second interior chamber, with a liquid-permeable membrane separating the first interior chamber and the second interior chamber within the body. The body may be configured to retain a first solid reactant in the first interior chamber and a second solid reactant in the second interior chamber, wherein the first rupture disk is configured to rupture at a pressure differential downhole. A method for livening a well may include lowering the wellbore tool into a wellbore.

19 Claims, 2 Drawing Sheets

AUTONOMOUS PRESSURE TRIGGERED WELL LIVENING TOOL WITH EXOTHERMIC NITROGEN PRODUCING CHEMISTRY

BACKGROUND

When oil or gas wells are treated by injection of fluids, such as acids for stimulation and formation damage removal or during well completions, the wells may not have enough reservoir pressure to push the accumulated fluids out from the wellbore. A nitrogen lift may be needed to help the wellbore rid the fluids so that reservoir hydrocarbons may be produced.

In conventional practices to liven the well, nitrogen gas is pumped through a coiled tubing reaching deep in the well. Expansion of the nitrogen in the well helps to lighten the fluid column and lift it, where lifting eventually helps production of the reservoir fluids. The conventional process uses a large footprint and incurs high cost associated with coiled tubing, nitrogen tanks, and a nitrogen truck. Such conventional processes entail risk to operators because of the use of coiled tubing. Steps of the conventional process include randomly selecting a depth to pump nitrogen, so materials are wasted. In addition, conventional practices to liven the well may be prohibitive in some offshore environments.

SUMMARY

This Summary is provided to introduce a selection of concepts that are further described in the Detailed Description. This Summary is not intended to identify key or essential features of the claimed subject matter, nor is it intended to be used as an aid in limiting the scope of the claimed subject matter.

In one aspect, embodiments disclosed relate to a wellbore tool. The wellbore tool may include a port through the body and a first rupture disk disposed on the body and covering the port, the body defining a first interior chamber and a second interior chamber, with a liquid-permeable membrane separating the first interior chamber and the second interior chamber within the body. The body may be configured to retain a first solid reactant in the first interior chamber and a second solid reactant in the second interior chamber, wherein the first rupture disk is configured to rupture at a pressure differential downhole.

In another aspect, embodiments disclosed relate to a method for livening a well comprising lowering one or more embodiments of the wellbore tool into a wellbore.

Other aspects and advantages of the claimed subject matter will be apparent from the following Detailed Description and the appended Claims.

Figure 1:
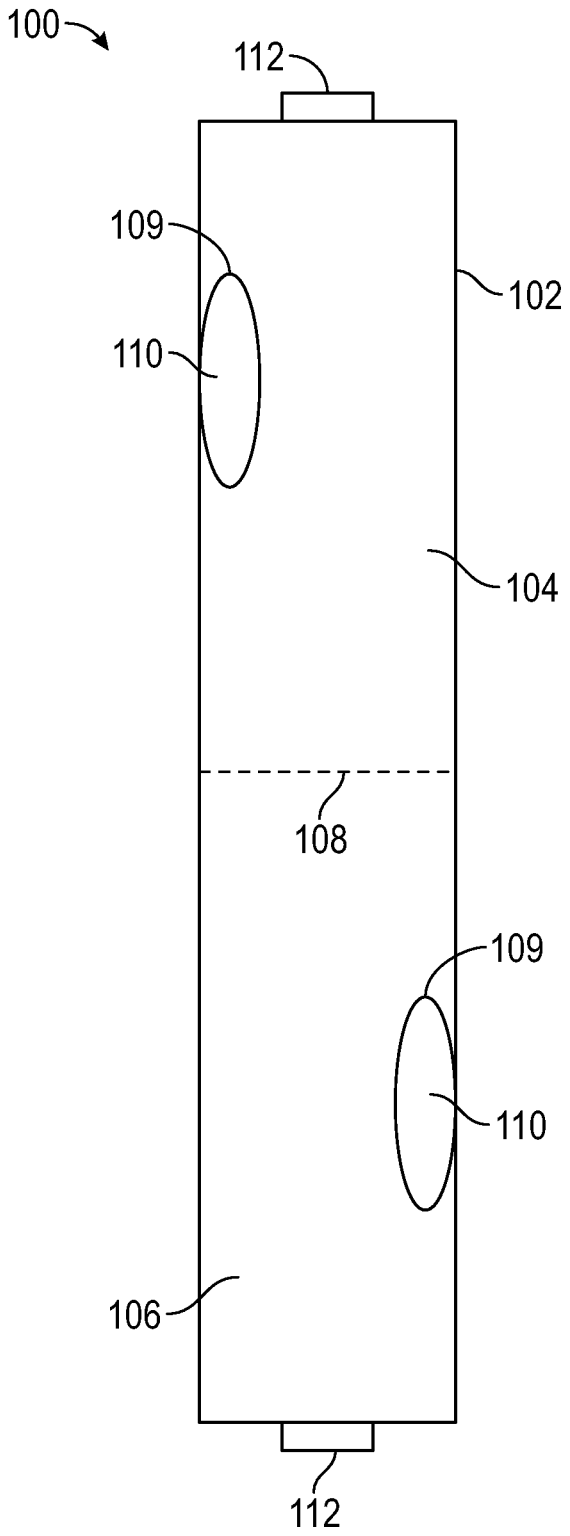
FIG. 1 shows a wellbore tool according to one or more embodiments.

Specific embodiments of the disclosure will now be described in detail with reference to the accompanying figures. Other aspects and advantages of this disclosure will be apparent from the following description made with reference to the accompanying Drawings and the appended Claims.

DETAILED DESCRIPTION

Specific embodiments of the disclosure will now be described in detail with reference to the accompanying figures. Like elements in the various figures are denoted by like reference numerals for consistency.

In the following Detailed Description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

One or more embodiments of the present disclosure relate to a wellbore tool that is activated by pressures downhole. The wellbore tool may be used for well livening by the production of nitrogen gas upon activation of the tool. The wellbore tool includes a rupture disk that breaks at a desired pressure downhole, followed by an influx of aqueous based fluid into the wellbore tool, then mixing of reactants that produce nitrogen gas in an exothermic reaction, and an efflux of nitrogen gas out of the wellbore tool. The operation of the tool is autonomous after the tool is lowered to its estimated depth, using the pressure of the fluids within the wellbore to trigger tool activation.

Apparatus and System

FIG. 1 depicts a wellbore tool 100 that includes a body 102 defining a first interior chamber 104 and a second interior chamber 106. The two interior chambers are separated by a liquid-permeable membrane 108. In FIG. 1, the liquid-permeable membrane is positioned radially (shown horizontally in the depiction), but may be positioned axially in other embodiments. A port 109 is provided to allow flow into and out of the first interior chamber 104, and a port 109 is also provided to allow flow into and out of the second interior chamber 106. A rupture disk 110 is disposed within each port on the body of the chamber proximate to the first and second interior chambers. A coupling 112 is shown that may couple with a suitable linking assembly, for example, to a wireline or another wellbore tool for transport of the tool to and from a downhole location. Two couplings are shown in FIG. 1, one on each of the upstream and downstream ends of the wellbore tool. When another wellbore tool is coupled, it may be the same or a different wellbore tool.

The body of the wellbore tool may be tubular in configuration, although other shapes may be used. The body has a length, an exterior surface, and a thickness, defining an internal volume with a first interior chamber and a second interior chamber. The first interior chamber and the second interior chamber are partitioned by a liquid-permeable membrane. The body is configured to retain a solid reactant within each chamber. A first reactant may be disposed within the first interior chamber, and a second reactant may be disposed within the second interior chamber. The body is configured to remain intact at ambient pressures, downhole pressures, and pressures when the reaction is triggered between the two reactants on the inside of the wellbore tool. An internal volume of the tool is sufficient to contain the reactants that will produce a desired amount of nitrogen to provide lift of the wellbore fluids.

The width of the body may be from 1% to 99% of the diameter of the well bore, such as 10% to 99%, 10% to 95%, 10% to 90%, 20% to 99%, 20% to 95%, 20% to 90%, 30% to 99%, 30% to 95%, 30% to 90%, 40% to 99%, 40% to 95%, 40% to 90%, 50% to 99%, 50% to 95%, 50% to 90%, 60% to 99%, 60% to 95%, 60% to 90%, 70% to 99%, 70% to 95%, 70% to 90%, 80% to 99%, 80% to 95%, or 80% to 90% of the diameter of the well bore. The length of the body may be from 0.5 to 25 meters, such as from 0.5 to 20 meters, 0.5 to 15 meters, 0.5 to 10 meters, 0.5 to 9 meters, 0.5 to 8 meters, 0.5 to 7 meters, 0.5 to 6 meters 0.5 to 5 meters, 0.5 to 4 meters, 0.5 to 3 meters, 0.5 to 2 meters, or 0.5 to 1 meter. The body thickness (thickness of the shell or wall) is any suitable thickness, for example, 1 to 300 mm, 1 to 250 mm, 1 to 200 mm, 1 to 150 mm, 1 to 100 mm, 1 to 50 mm, 1 to 40 mm, 1 to 35 mm, 1 to 30 mm, 1 to 25 mm, 1 to 20 mm, 1 to 15 mm, 1 to 10 mm, 1 to 5 mm, and 1 to 2.5 mm, 0.5 to 15 mm, 0.5 to 10 mm, 0.5 to 5 mm, 0.5 to 2.5 mm, and 0.5 to 2 mm.

The body may be formed from steel or stainless steel, for example, although other materials of construction may also be used. The body has a thickness suitable to withstand pressures as may be encountered downhole.

The body may be constructed in various manners to permit disposal of the reactants and the liquid-permeable membrane within the body, as well as for re-use of the tool for subsequent downhole operations. For example, removable end caps on one or each of the ends may be provided, allowing access to the interior volume of the tool. In such an embodiment having one end cap, the rupture disks 110 may be installed, then a first solid reactant may be disposed in the second interior chamber 106, the liquid-permeable membrane installed, and then the second solid reactant may be disposed in the first interior chamber, after which the end cap may be installed to seal the internal chambers from the outside environment. Alternatively, the body may be of two-piece construction, having a threaded body section allowing connection of the first and second parts of the body. In such an embodiment, the rupture disks 110 may be installed on each body part, the solid reactants disposed within the respective internal chambers, the membrane installed, and the body parts connected.

While illustrated in FIG. 1 as including a single port to allow fluid flow into each of the upper and lower chambers, embodiments herein may include one or more ports through the body, such as two or more ports providing for flow into and out of the upper chamber and/or two or more ports providing for flow into and out of the lower chamber. In this manner, the flow may be controlled, such as by port size and location, and the efflux of nitrogen into the annular space may be distributed. While the rupture disks and associated ports may be located anywhere along the body with respect to the chambers, it may be desirable to locate an uppermost port at or near an end of the body, such that a minimal volume of generated nitrogen is trapped within an upper enclosed interior volume of the body.

The configuration of the first and second internal chambers depends on the positioning of the liquid-permeable membrane. For example, the liquid-permeable membrane that bifurcates the internal volume of the body may be arranged radially (width-wise) or axially (length-wise). When the liquid-permeable membrane is positioned radially, the first (upstream-most) internal chamber is upstream of the second internal chamber. When the liquid-permeable membrane is positioned axially, the first internal chamber and the second internal chamber are arranged next to each other in the body. When positioned axially, the body may include an end cap, the membrane may be installed, after which the solid reactants may be disposed within the respective internal chambers, and then the end cap may be installed to seal the internal chambers from the outside environment. Other various configurations for the body may be readily envisioned that permit both access and installation of the reactants and membrane within the body.

As noted above, the first internal chamber is configured to retain a first solid reactant. And, the second internal chamber is configured to retain a second solid reactant. The volume provided for each chamber may depend upon the reactants used, the shape, density, packing density, etc. of the solid reactants. It is desirable to dispose the reactants within the tool at approximately a stoichiometric ratio, and thus the volumes of the chambers are be configured to accommodate disposal of a desired amount of each reactant within the respective chambers.

The liquid-permeable membrane is included to separate the solid reactants within the first and the second internal chambers, thereby preventing solid reactants from interacting and reacting prematurely. In addition, the liquid-permeable membrane slows the rate of diffusion of a liquid (fluid) across the membrane, thereby preventing a fast reaction between reactants. Accordingly, it is desirable to install the liquid permeable membrane within the tool such that liquids and solids may not pass around (bypass) the membrane, but to where the liquid pass through the membrane to initiate contact of dissolved reactants.

The liquid-permeable membrane may be made from any suitable material, including but not limited to solid glass or plastic, with a porous structure allowing fluids (liquids and gases) to pass through and not solids. The porous structure may be a mesh. The porous or mesh structure of the membrane have pores or holes smaller than the smallest particle of the solid reactants, as installed or as may result from particle attrition during transport, thereby limiting traversal of solids between the chambers and preventing premature contact of the reactants. The pores or holes of the membrane are large enough, however, to permit liquid and vapor (gas) traffic through the membrane. In one or more embodiments, the pore size of the liquid-permeable membrane is from 1 to 50 nm, such as from 2 to 20 nm, or such as in a range having a lower limit of any of 1, 2, 3, or 5 nm, and having an upper limit of any of 6, 7, 8, 9, 10, 11, 12, 13, 14, 15, 16, 17, 18, 19, 20, 21, 22, 23, 24, 25, 30, 35, 40, 45, or 50 nm.

The thickness of the liquid-permeable membrane used may depend upon the type of membrane and the configuration of the tool, noting that the membrane is of sufficient strength to prevent breakage of the membrane during assembly of the tool as well as during transport to a wellsite and within the wellbore. In one or more embodiments, the thickness of the liquid-permeable membrane is from 1 to 20 mm, such as from 2 to 10 mm, or such as in a range having a lower limit of any of 0.1, 0.5, 1.0, 1.5, or 2.0 mm, and having an upper limit of any of 3.0, 4.0, 5.0, 6.0, 7.0, 8.0, 9.0, 10.0, 15.0, or 20.0 mm.

The liquid-permeable membrane has a permeability sufficient to control a rate of nitrogen generation within the wellbore tool. Without wanting to be bound by theory, the permeability of the liquid-permeable membrane provides a reactant (dissolved reactant) flux across the membrane such that a gentle evolution of gas (such as nitrogen) results, and not a burst or explosion of gas (rapid pressure increase). Permeability of the liquid-permeable membrane is associated with the mesh size of the membrane, and may be adjusted prior to use to provide a gentle evolution of gas, while blocking solids transport from one interior chamber to another interior chamber.

There is one or more rupture disk on the body. For example, there may be one or more rupture disks on the body, such as 2, 3, 4, 5, 6, 7, 8, 9, 10, 11, 12, or more rupture disks. The rupture disk separates the internal contents of the wellbore tool from the external environment. For example, the rupture disk separates a solid and a gas inside the body from the pressure outside the wellbore tool (external pressure). The external pressure may be the pressure in the wellbore when the wellbore tool is downhole. The rupture disk covers (seals off) one or more port through the body. More than one rupture disk may also cover (seal off) one port through the body.

The rupture disk is configured to rupture at a particular pressure so that fluid, such as aqueous fluid or brine, is accessible between outside and inside the body upon rupture. The pressure is an estimated differential pressure downhole between the exterior pressure and the interior pressure of the wellbore tool, which may correspond with a depth that is determinable.

The pressure setting for the rupture disk (differential pressure between exterior and interior of wellbore tool) may be determined by calculation based upon the properties of the wellbore fluid and the proposed depth of rupture. The proposed depth of rupture may be a location in the wellbore where nitrogen gas is to be deployed.

The rupture disk may be of any suitable material that seals off (separates) the contents on either side of the rupture disk from each other, until the rupture disk breaks at the desired pressure. Examples of materials include, but are not limited to, steel, carbon steel, stainless steel, aluminum, nickel alloy, hastelloy, graphite, carbon fiber, carbon nanomaterials (such as nanosheets), polymer, and other suitable materials that may be used for rupture disks.

The rupture disks may be inward-bursting when the pressure to break the disks is from the associated well depth. Thus, the shape and 2-dimensional or 3-dimensional configuration of the rupture disk may withstand pressure fluctuations within the wellbore tool, while breaking at the desired pressure from the outside, toward the interior of the wellbore tool. In one or more embodiments, the rupture disk may be a 2D shape including, but not limited to a circle, oval, triangle, square, rectangle, pentagon, hexagon, octagon, or other suitable geometrical shape. In one or more embodiments, the rupture disk may be a 3D shape including, but not limited to a sphere, hemisphere, hollow sphere (bubble or irregular sphere egg-shell shape), hollow hemisphere (or irregular sphere half-egg type shape), a geometric prism (or hollow prism) not limited to a triangular-, square-, rectangular-, pentagonal-, hexagonal-, or octagonal-prism. The rupture disk may be any suitable sleeve disposed around or on the exterior circumference of the body of the wellbore tool and covering a port through the body. There may be one or more sleeve. When the rupture disk is a sleeve, the rupture disk may cover more than one port through the body of the wellbore tool. The rupture disk may be one or more adhesive sticker on the exterior, interior, or exterior and interior of the body covering a port through the body. The rupture disk may be disposed on the interior of the body, such as a balloon covering a port through the body, or a pressure-activated filler material on the interior of the body. The rupture disk may be a weak point of the body without a port, for example, one or more etchings (partially drilled holes or router-cut shape) on the exterior or interior of the body that does not etch all the way through the body (shell), and is designed to break at the desired pressure. In this way, a rupture disk that is broken open may be a port through the body.

A chamber is configured to retain a solid reactant. For example, a first chamber in a wellbore tool is configured to retain a first solid reactant. A second chamber in the wellbore tool is configured to retain a second solid reactant. The two solid reactants are separated by the liquid-permeable membrane that allows liquids, but not solids, to pass through.

The reactants, when contacted, may result in an exothermic reaction that produces nitrogen gas and heat. The solid reactant(s) may dissolve in an aqueous solution, for example, water or brine. When a solid reactant dissolves, it becomes a dissolved reactant and may flow through the liquid-permeable membrane and be contacted with the other solid reactant (the other reactant may also be dissolved).

For example, a first solid reactant may dissolve or disintegrate upon contact with aqueous solution in a first interior chamber. This first dissolved reactant may pass through the liquid-permeable membrane to the second interior chamber and may intermingle with a second solid reactant (or a second dissolved reactant). The interaction of the first and second reactants results in reaction of the components, producing nitrogen.

The opposite may also occur, where the second solid reactant dissolves or disintegrates, flows through the liquid-permeable membrane, and intermingles with the first solid reactant (or first dissolved reactant).

When the first and the second reactants intermingle, they may react in an exothermic reaction that produces nitrogen gas. The quantity of reactants provided in the chambers is of sufficient quantity to result in generation of sufficient nitrogen gas to facilitate the desired effect downhole. For example, the amount of nitrogen produced by reaction of the reactants may provide a desired lift to the wellbore, facilitating transport of wellbore fluids toward the surface. The rate of reaction, and thus the rate of gas production, may be limited by the transport properties of the membrane, limiting the rate at which the reactants are contacted. The amount of nitrogen produced by the wellbore tool of one or more embodiments may be sufficient to replace the volume of water above the wellbore tool (situated at its desired depth in a well).

The reactants are water-soluble. The reactant materials include, but are not limited to, ammonium chloride as a first solid reactant and sodium nitrate as a second solid reactant. A reactant may be disposed in the first interior chamber, and another reactant may be disposed in the second interior chamber. The position of the reactants (in the first or second interior chamber) is not particularly limited, as long as the reactants are separated by a liquid-permeable membrane.

Figure 2:
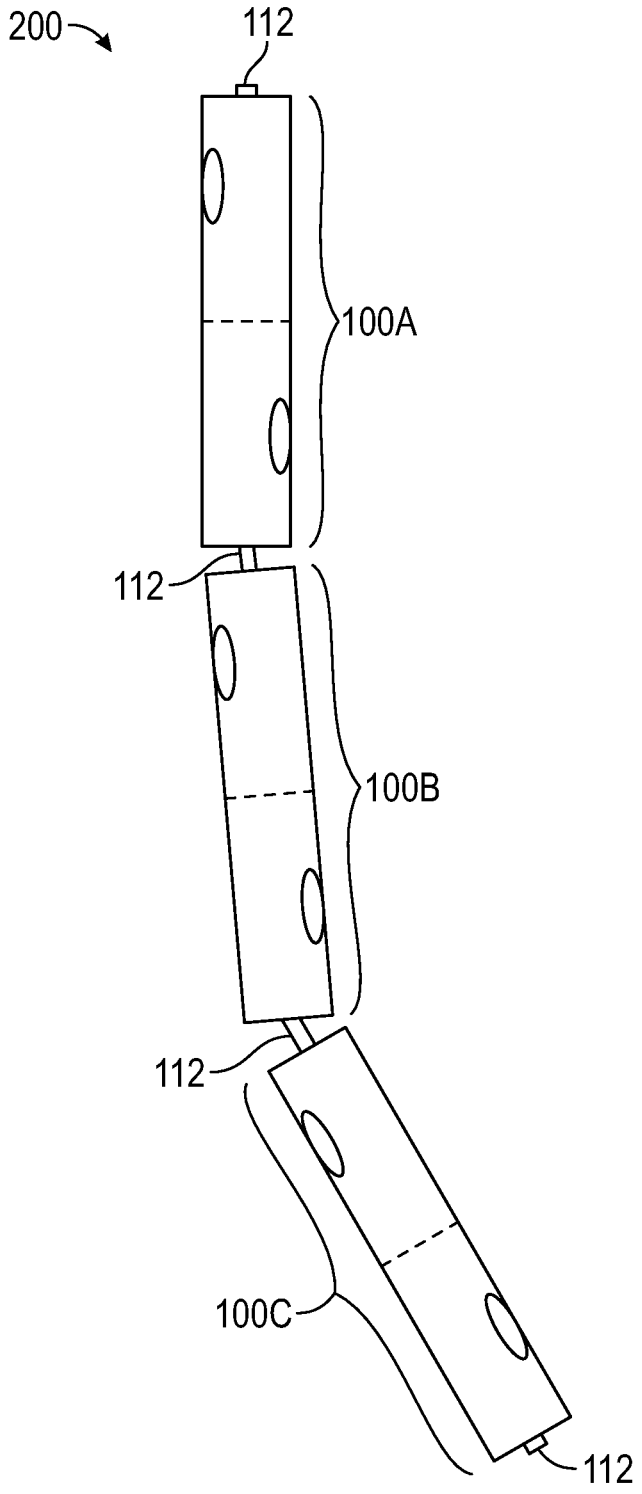
FIG. 2 shows multiple wellbore tools in series according to one or more embodiments.

The apparatus may include two or more wellbore tools. FIG. 2 depicts multiple wellbore tools 200 coupled in series. A first wellbore tool 100A is shown upstream of a second wellbore tool 100B, which is upstream of a third wellbore tool 100C. The multiple wellbore tools are coupled via a coupling 112 between each wellbore tool in series. The first wellbore tool includes a coupling 112 that may couple to a suitable linking assembly, for example, a wireline.

There may be more than one wellbore tool positioned in series, coupled together lengthwise. Each wellbore tool may have the same or a different amount of a solid reactant within each chamber. Each wellbore tool may have the same or a different number of rupture disks on the body.

The multiple wellbore tools in series may have rupture disks that rupture at the same or a different pressure differential downhole.

Alternatively, each wellbore tool in series may have rupture disks that rupture at a different pressure. For multiple wellbore tools in series, an upstream-most wellbore tool (closest to the surface) may include rupture disks configured to burst at a first pressure, a second wellbore tool (downstream of the upstream-most wellbore tool) may include rupture disks configured to burst at a second pressure, and a third wellbore tool (downstream of the second wellbore tool) may have rupture disks configured to burst at a third pressure, and so on for further wellbore tools that are coupled in series. The first pressure may be the lowest pressure (compared to the other pressures in the series), the second pressure may be greater than the first pressure, and the third pressure may be greater than the second pressure. The downstream-most wellbore tool is envisaged to have rupture disks configured to rupture at the greatest pressure, compared to the break pressure of the rupture disks on the wellbore tools upstream of the downstream-most wellbore tool.

Method

One or more embodiments of the method utilize exothermic reactions between reactants within the wellbore tool to liven dead wells in which the reservoir pressure is lower than the gradient pressure of fluids filling a wellbore.

A method to use the wellbore tool according to one or more embodiments may include introducing the wellbore tool into a well. The wellbore tool may be introduced by a wireline truck, for example. The wellbore tool may also be configured to be disposed within the wellbore using coiled tubing or drill pipe, for example. The wellbore tool may be used with water-based drilling fluids or oil-based drilling fluids having an aqueous component for dissolution of the reactants.

Next, one or more embodiments of the method may include positioning the wellbore tool at a depth associated with the estimated wellbore pressure that may break (rupture) a rupture disk.

Upon positioning the wellbore tool in the region having the estimated wellbore pressure, the rupture disk may break and rupture. In one or more embodiments, the rupturing (or breaking) of the rupture disk proceeds without manual activation. Breaking open the rupture disk permits wellbore fluid to enter the wellbore tool.

Initially, the flux rate of aqueous wellbore fluid that passes through the broken rupture disk into the wellbore tool is driven by gravity, along with the rapid change in pressure differential downhole upon rupture disk breakage. The pressure differential downhole may be similar to that of an estimated pressure differential at a wellbore depth (external pressure minus pressure inside the wellbore tool). The estimated pressure differential at a wellbore depth may be calculated prior to fitting the rupture disk associated with this pressure differential, so that the rupture disk breaks at the provided pressure differential downhole.

The aqueous wellbore fluid passes through the broken rupture disk into an interior chamber where it intermingles with a solid reactant and wets the membrane. Where two or more rupture disks are included, aqueous wellbore fluid may pass into the body of the wellbore tool at the position of the ruptured disks. So, an influx of aqueous wellbore fluid may be in one chamber or both chambers, at one or more position on a single chamber, or at one or more position on both chambers.

For example, when there is a rupture disk proximate to both a first interior chamber and a second interior chamber, the multiple rupture disks may break at the same pressure and allow fluid to pass into the interior of both chambers simultaneously.

The wellbore fluid dissolves or disintegrates the solid reactant within the interior of the chamber and wets the liquid-permeable membrane. The wellbore fluid may pass through the liquid-permeable membrane and dissolve or disintegrate solid reactants on either side of the liquid-permeable membrane (a solid reactant in each chamber).

As the solid reactant dissolves or disintegrates, it becomes a liquid reactant. A "liquid reactant" means that a solid reactant is dissolved or disintegrated in the aqueous wellbore fluid. For example, a first solid reactant may dissolve and become a first liquid reactant. The first liquid reactant may diffuse across the liquid-permeable membrane where it interacts with a second solid reactant or a second liquid reactant.

As the reactants mix (liquid-liquid or liquid-solid interaction), they react exothermically to produce nitrogen and heat. The produced nitrogen leaves the wellbore tool via a ruptured disk (openings) and mixes with the surrounding wellbore fluid. The heat generated due to reaction within the wellbore tool, and turbulence provided by the nitrogen gas production, may increase reaction rates and/or facilitate reactant mixing, fueling more nitrogen production.

The nitrogen gas creates a buoyancy in the surrounding fluid as it escapes the wellbore tool, thereby reducing fluid density and creating uplift in the wellbore fluid. The bluff of nitrogen gas will lift the fluids in the wellbore and remove the gradient effect on choking the reservoir fluids, such that the reservoir fluids (hydrocarbons) may be produced by the natural reservoir pressure. In this way, the wellbore fluid column lightens and may facilitate the initiation of production from the reservoir.

An operator may observe the lightening of the wellbore fluid occurring on the surface by an increase in the wellhead pressure. If the pressure persists for an extended period, then it means that the reservoir pressure is producing (reservoir hydrocarbon fluids). On the other hand, if the increase in wellhead pressure dies off after some time, this means that the depth reached by the wellbore tool was not sufficient to lighten the wellbore fluids column. Proceeding with the operation at greater depths may lighten the wellbore fluids column.

One way to proceed with operation at greater depths or pressures is to introduce a new wellbore tool fitted with solid chemicals loaded in the chambers and rupture disks that are configured to rupture at a greater pressure into the wellbore at a greater depth. The operation may proceed, resulting in lifting the wellbore. Thus, one or more embodiments of the method may include withdrawing the wellbore tool from the well to use a new wellbore tool in a subsequent operation. One or more embodiments of the method may also include re-introducing the wellbore tool into the same or a different wellbore.

Alternatively, a wellbore tool that was removed from the wellbore can be cleaned, refitted with solid chemicals loaded in the chambers, and new rupture disks installed that are configured to rupture at a greater pressure associated with a deeper wellbore depth. Thus, one or more embodiments of the method may include cleaning the wellbore tool, loading additional reactants in the wellbore, and installing rupture discs on the wellbore tool.

One way to proceed with operation at greater depths is to use a series of wellbore tools (for example, depicted in FIG. 2). As this series of wellbore tools is introduced into the wellbore, the rupture disks on the first (upstream-most or downstream-most) wellbore tool may be configured to rupture at the first pressure. This first pressure may be the weakest estimated pressure associated with the least wellbore depth, compared to depth of other wellbore tools in the series. If the depth reached by the first wellbore tool is not sufficient to lighten the wellbore fluids column, the series of wellbore tools may be introduced deeper into the well.

As the series of wellbore tools is lowered further, the rupture disks on the second wellbore tool are configured to rupture at a second pressure, which is a greater estimated pressure than the first pressure and is associated with a deeper wellbore depth. Again, if the depth reached by the second wellbore tool is not sufficient to lighten the wellbore fluids column, the series of wellbore tools may be introduced deeper into the well.

As the series of wellbore tools are loaded still further into the well, the rupture disks on the third wellbore tool are configured to rupture at a third pressure, an even greater pressure than the second pressure, which is associated with an even deeper wellbore depth. In this manner, two, three, or more wellbore tools may be combined with progressive rupture disks in series such that multiple attempts at lightening the wellbore may occur with a single series of tools. There is no particular limit on the number of wellbore tools that may be coupled in series.

EXAMPLES

The following example is a demonstration of operating a wellbore tool in series, with reference to FIGS. 1 and 2.

The first wellbore tool has one or more rupture disk that rupture at a pressure P1, the second wellbore tool has one or more rupture disk that rupture at a pressure P2, the third wellbore tool has one or more rupture disk that rupture at a pressure P3. The order of the pressures, from greatest to least is P3>P2>P1. The reservoir pressure (surrounding fluid) is Pr.

P1 is a greater estimated pressure than reservoir pressure if the operation of the first wellbore tool is to help lift the fluids out of the well. Otherwise, the greater P2 pressure and depth is reached by lowering the series of wellbore tools.

Assuming a well of true vertical depth (TVD) of 10,000 ft, and a reservoir pressure Pr, then the weight of the fluid column in the wellbore is gradient of fluid X height of fluid in the wellbore. Depending on how high or low Pr is, P1, P2 and P3 can be estimated.

To estimate an amount of nitrogen to be produced by the exothermic reaction between the two reactants, the following calculations may be used.

TVD (ft) is well true vertical depth. G (psi/ft) is fluid gradient in the well, which is the weight of the fluid in the well.

Pressure in the well is G×TVD psi; for water, which is a base component of the fluids used in well treatment, the value is 0.433 psi/ft.

This volume is TVD×well cross-sectional area ($\pi r^2$).

To estimate the volume of nitrogen to lift the well fluids, an exothermic reaction involving two solid chemicals such as ammonium chloride $NH_4Cl$ and sodium nitrite $NaNO_2$ or any other solid exothermic reactants can be used. For example:

$$NH_4Cl+NaNO_2 \rightarrow N_2+2H_2O+NaCl$$

Assuming that the nitrogen gas ($N_2$) gradient in the well is negligible in comparison to the weight of fluids, to produce enough nitrogen gas $N_2$ to fill the wellbore, the gas equation may be used: $P_iV_i=P_fV_f$.

$P_i$ is the initial pressure on the produced amount of nitrogen when the reaction begins. This pressure is the weight of the fluids filling the wellbore and killing the well. This pressure is TVD(ft)×0.433 (psi/ft). $P_f$ is the final pressure after nitrogen expansion pushing the fluids out of the hole. This pressure may be either the atmospheric pressure if the well is open to a flare pit or the trunk line pressure if the well is open to the production gathering system.

For this example, an assumed atmospheric pressure for $P_f$ is 14.7 psi.

$$V_i=P_fV_f/P_i=14.7\ (\text{psi})\times \text{TVD}\times\pi r^2/(\text{TVD}\times 0.433)=14.7\ (\text{psi})\times\pi r^2\ (\text{ft}^2)/0.433\ (\text{psi/ft})=106.6\ (\text{ft})\times r^2\ (\text{ft}^2)$$

For a well with 4-inch diameter, $r^2=(2/12)^2=0.028\ \text{ft}^2$

This makes $V_i=2.96\ \text{ft}^3$. This volume is at the pressure at a depth of the well. When the depth at which the first stage of the tool is triggered, such as 4000 ft, this pressure will be 4000 ft×0.433 (psi/ft)=1732 psi.

Considering the example shown to be P1, similar steps of calculations can be carried out for another depth with higher P2 pressure and so on for higher depth P3.

With the amount of nitrogen gas needed to lift the well, the size of the tool and the amount of exothermic reactants can be estimated using the above example.

Advantages

The wellbore tool described in one or more embodiments herein is easy to manufacture, to measure reactants and rupture disk burst pressures, to fit and load, and to introduce into a wellbore. The wellbore tool can be a significant cost savings by easier and faster deployment than gaseous or liquid nitrogen, especially for remote fields located away from liquid nitrogen storage facilities or air separations units.

The wellbore tool is easy to use. An operator merely has to introduce the wellbore tool of one or more embodiments into the well and the remainder of the process occurs as designed. The calculations for amounts of chemical and pressure at deployment are pre-determined during tool loading and fitting, thereby efficiently controlling the amount of nitrogen gas produced.

The wellbore tool is safe. There is little risk involved to field operators when using the wellbore tool and method of one or more embodiments, because there are no pressurized materials, explosives, or propellants, and the wellbore tool is sealed. In addition, there are no units relying on sub-zero temperatures, the wellbore tool may be loaded via wireline, and all chemical reactions occur downhole.

The wellbore tool of one or more embodiments works in both oil and gas wells, horizontal or vertical producers.

The wellbore tool of one or more embodiments saves the cost of having a nitrogen truck and coiled tubing in vertical wells, both of which are expensive equipment in oil field operations. The wellbore tool and methods of one or more embodiments uses a small footprint. The proposed wellbore tool of one or more embodiments is simple to use and is based on known chemistry and physics principles, it has a small footprint, and is cost effective compared to conventional tools and techniques of well livening.

One or more embodiments of the disclosure include a well livening downhole tool for the in-situ production of nitrogen to lighten the fluid column in a well and thus lift the well fluids. The well livening downhole tool may include two or more solid reactants to produce nitrogen. One or more embodiments of the well-livening downhole tool include multiple modules each having nitrogen-producing reactants that each module may be activated independently to produce nitrogen at different depths.

Advantageously, as compared to propellant-based well lifting techniques, the wellbore tool described in one or more embodiments of the disclosure enables the in-situ production of nitrogen downhole without the significant heat generation and potential hazards of propellants. The well livening downhole tool described in the disclosure may have reduced cost and complexity as compared to conventional well lift techniques that use a gas container that pumps gas downhole. Additionally, the well livening tool described in the disclosure may operate autonomously after the tool is lowered to a desired depth in a well.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

When the word "approximately" or "about" are used, this term may mean that there can be a variance in value of up to ±10%, of up to 5%, of up to 2%, of up to 1%, of up to 0.5%, of up to 0.1%, or up to 0.01%.

"Optionally" and all grammatical variations thereof as used refers to a subsequently described event or circumstance that may or may not occur. The description includes instances where the event or circumstance occurs and instances where it does not occur.

The term "substantially" and all grammatical variations thereof as used refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

Thus, particular implementations of the subject matter have been described. Other implementations are within the scope of the following claims Although only a few example embodiments have been described in detail, those skilled in the art will readily appreciate that many modifications are possible in the example embodiments without materially departing from the scope of the disclosure. Accordingly, all such modifications are intended to be included within the scope of this disclosure as defined in the following claims. In the claims, means-plus-function clauses are intended to cover the structures described as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims, except for those in which the claim expressly uses the words 'means for' together with an associated function.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open-ended phrase to introduce a recitation of a series of elements, components, materials, or steps should be interpreted to also disclose recitation of the series of elements, components, materials, or steps using the closed terms "consisting of" and "consisting essentially of" For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of." The words "comprise," "has," and "include" and all grammatical variations thereof are each intended to have an open, non-limiting meaning that does not exclude additional elements or steps.

What is claimed:

1. A wellbore tool, comprising:

a body comprising a port through the body and a first rupture disk disposed on the body and covering the port, the body defining a first interior chamber and a second interior chamber, with a liquid-permeable membrane separating the first interior chamber and the second interior chamber within the body, wherein the liquid-permeable membrane is one or more material selected from the group consisting of solid glass and plastic, and wherein the body is configured to retain a first solid reactant in the first interior chamber and a second solid reactant in the second interior chamber, wherein the first rupture disk is configured to rupture at a pressure differential downhole.

2. The wellbore tool of claim 1, wherein the body is tubular in configuration.

3. The wellbore tool of claim 1, wherein the first solid reactant and the second solid reactant are water-soluble.

4. The wellbore tool of claim 1, wherein the first solid reactant is ammonium chloride, and the second solid reactant is sodium nitrate.

5. The wellbore tool of claim 1, wherein the liquid-permeable membrane is arranged radially in the body.

6. The wellbore tool of claim 1, wherein the liquid-permeable membrane is arranged axially in the body.

7. The wellbore tool of claim 1, wherein the body comprises a second rupture disk configured to rupture at the pressure differential downhole.

8. The wellbore tool of claim 1, further comprising two or more ports through the body.

9. The wellbore tool of claim 8, wherein:

the two or more ports through the body define access to the first interior chamber, and the first rupture disk and a second rupture disk are disposed on the body proximate the first interior chamber.

10. The wellbore tool of claim 8, wherein:

the two or more ports through the body define access to the second interior chamber, and the first rupture disk and a second rupture disk are disposed on the body proximate the second interior chamber.

11. The wellbore tool of claim 8, wherein:

the two or more ports through the body define access to the first interior chamber and the second interior chamber, and the first rupture disk is disposed on the body proximate the first interior chamber and a second rupture disk is disposed on the body proximate the second interior chamber.

12. A method for livening a well comprising lowering the wellbore tool of claim 1 into a wellbore.

13. The method of claim 12, further comprising estimating the pressure differential downhole at a wellbore depth proximate to a reservoir.

14. The method of claim 12, further comprising providing a membrane having a permeability to control a rate of nitrogen generation within the wellbore tool.

15. The method of claim 12, further comprising installing the first rupture disk on the body of the wellbore tool wherein the pressure differential is similar to that of an estimated pressure differential at a wellbore depth (external pressure minus pressure inside the wellbore tool).

16. The method of claim 12, further comprising installing the wellbore tool on a wireline prior to introducing the wellbore tool into the wellbore.

17. The method of claim 16, further comprising disposing two or more wellbore tools on the wireline, each wellbore tool having a first rupture disk configured to rupture at the pressure differential downhole or a different pressure differential downhole.

18. The method of claim 12, further comprising withdrawing the wellbore tool, loading an additional reactant in the wellbore tool, installing a rupture disk on the wellbore tool, and re-introducing the wellbore tool into the wellbore or a different wellbore.

19. The method of claim 18, further comprising cleaning the wellbore tool.

* * * * *